US006264059B1

(12) United States Patent
Requena

(10) Patent No.: US 6,264,059 B1
(45) Date of Patent: Jul. 24, 2001

(54) APPARATUS FOR DISPENSING PLASTIC BAGS

(75) Inventor: Eduardo A. Requena, Houston, TX (US)

(73) Assignee: Better Bags, Inc., Houston, TX (US)

( * ) Notice: Subject to any disclaimer, the term of this patent is extended or adjusted under 35 U.S.C. 154(b) by 0 days.

(21) Appl. No.: 09/483,627

(22) Filed: Jan. 14, 2000

(51) Int. Cl.[7] ..... A47K 10/24

(52) U.S. Cl. ..... 221/45; 206/554; 248/100

(58) Field of Search ..... 221/33, 45, 48, 221/34, 63, 47, 46; 206/554, 494, 493; 211/168, 96, 59.1, 59.2; 248/95, 100

(56) References Cited

U.S. PATENT DOCUMENTS

| | | | |
|---|---|---|---|
| 271,177 | 1/1883 | White . | |
| 1,002,639 | 9/1911 | Broussard . | |
| 2,564,997 | 8/1951 | Rome | 296/57 |
| 2,682,956 | 7/1954 | Pike | 211/71 |
| 3,044,233 | 7/1962 | Altman, Jr. | 53/385 |
| 3,285,407 | 11/1966 | Abramson | 206/57 |
| 3,747,298 | 7/1973 | Lieberman | 53/390 |
| 3,827,571 | 8/1974 | Koutny | 211/59 |
| 3,973,376 | 8/1976 | Suominen | 53/385 |
| 4,005,801 | 2/1977 | Musser | 221/56 |
| 4,407,317 | 10/1983 | Crandall | 135/27 |
| 4,542,827 | 9/1985 | Pilzer | 206/483 |
| 4,981,216 | 1/1991 | Wilfong, Jr. | 206/554 |
| 5,020,750 | 6/1991 | Vrooman et al. | 248/97 |
| 5,038,946 | 8/1991 | Tenser et al. | 211/168 |
| 5,060,809 | 10/1991 | Bayes et al. | 211/59.1 |
| 5,060,897 | 10/1991 | Thalenfeld | 248/220.4 |
| 5,119,968 | 6/1992 | Palmer | 221/26 |
| 5,213,134 | 5/1993 | Orlandi | 137/625.4 |
| 5,269,416 | 12/1993 | DeMatteis | 211/50 |
| 5,269,423 | 12/1993 | Nguyen | 206/554 |
| 5,310,102 | 5/1994 | Hougham | 224/267 |
| 5,332,097 | 7/1994 | Wile | 206/554 |
| 5,368,165 | 11/1994 | Nguyen | 206/554 |
| 5,450,964 | 9/1995 | Miller | 206/554 |
| 5,695,065 | 12/1997 | Kennedy et al. | 206/554 |
| 5,732,833 | 3/1998 | Alvarado et al. | 211/59.1 |

*Primary Examiner*—Kenneth W. Noland
(74) *Attorney, Agent, or Firm*—McGlinchey Stafford; Clarence Erikson

(57) ABSTRACT

A plastic bag dispensing apparatus is provided which comprises a bag shield for facilitating the removal of only one bag at a time from the stack and for maintaining the billboard effect of the bags in the stack. The shield may be of various sizes and have openings of various shapes.

3 Claims, 3 Drawing Sheets

APPARATUS FOR DISPENSING PLASTIC BAGS

BACKGROUND OF THE INVENTION

1. Field of the Invention

The present invention relates to an apparatus for dispensing plastic bags which includes a bag shield.

2. Description of the Prior Art

Plastic bags for customer use and convenience are widely used in many types of retail stores and are commonly provided in grocery stores and supermarkets. Plastic bags of the type to which the present invention is directed are often used in a grocery store as a means to hold produce items, e.g., fruits and vegetables, and may also be used to hold poultry, meat, seafood, and bakery products. The use of such bags facilitates the check out process, since the bags provide a means for segregating the various items purchased from one another.

Plastic bags have sometimes been manufactured in a continuous roll with a perforation between the adjacent bags. A bag is removed from such a roll by exerting force to tear a bag from the roll along a perforation. Once the bag has been removed, the customer is faced with the sometimes difficult task of opening the bag.

It is also known in the art to manufacture and assemble plastic bags into a bag stack, which are then dispensed from an appropriate assembly. Such a stack of bags includes a disposable upper portion which is detachably connected to a lower portion containing the plastic bags by making perforations between the upper portion and the lower portion. When a customer desires to use a plastic bag, the customer pulls on the outermost bag in the stack and tears it away from the upper disposable portion at the perforation.

The bag stacks described in the immediately preceding paragraph are mounted on dispensing assemblies, e.g., bag stands, in one of two ways. One way of mounting has been to attach a plastic hanger, generally referred to as a "header," to the disposable upper portions of the pack of plastic bags. The header includes one or more upper openings through which a supporting member of the bag stand extends to support the header pack of plastic bags. A second way of mounting is to make a pair of circular holes through the disposable upper portion of the bag stack and to hang or suspend the bag stack by inserting a supporting member through each of the holes. This type of plastic bag stack is commonly referred to as a "headerless" stack. Several packs of header bags or headerless bags will typically be hung or supported on the bag stand at any one time.

In many instances, the manufacture of a bag stack includes subjecting the material from which the bags are fabricated to what is known as a "Corona treatment." This Corona treatment enables the retail outlet or supermarket to have information printed on the bags using well-known techniques. The information which is printed on the bags is known in the industry as the "billboard effect."

Several problems have existed in the industry with respect to the dispensing of plastic bags from a bag stack. For example, difficulty has been encountered in the removal of only one bag from the bag stack at a time, and once removed, difficulty has also been encountered in opening the removed bag. Also, the removal of bags from a bag stack has interfered with the "billboard effect" of the remaining bags in the stack. These and other shortcomings of the prior art have been overcome by the apparatus for dispensing plastic bags of the present invention.

SUMMARY OF THE INVENTION

In accordance with the present invention, a plastic bag dispensing apparatus is provided which comprises a bag stand which includes at least one support hook. The apparatus of the present invention further includes a bag stack comprising a disposable upper portion and a lower bag portion. The lower bag portion comprises a plurality of plastic bags that are detachably connected to the upper portion, and the upper portion of the bag stack includes at least one hole associated therewith for removably mounting the bag stack on the support hook of the bag stand. The apparatus of the present invention further includes a shield which is made from a clear, flexible material which has a substantially planar front face having at least one hole therethrough for hanging the shield on the hook so that the shield is in front of the bag stack.

In accordance with the present invention, the shield has an opening formed therethrough which permits the removal of bags from the bag stack. In one embodiment, the opening through the shield has a substantially circular-shaped portion which is on top of and contiguous with a vertical elongate portion. In another embodiment, the opening through the shield has an upper horizontal elongate portion on top of and contiguous with a funnel-shaped portion that flares downwardly. In yet another embodiment of the present invention, the opening through the shield has an upper, substantially circular-shaped portion and a lower vertical elongate portion. In this embodiment, abutting projections are formed in the shield which are at the top of the vertical elongate portion of the opening and which separate the upper, substantially circular portion from the lower, vertical elongate portion.

DESCRIPTION OF SPECIFIC EMBODIMENTS

Figure 1:
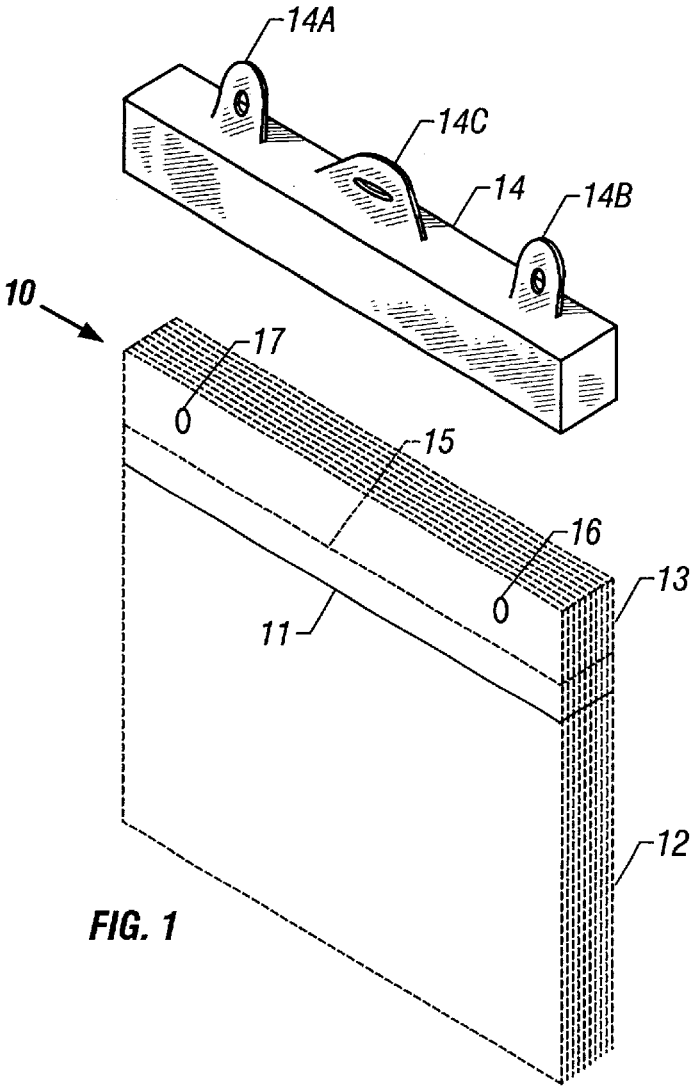
FIG. 1 is a perspective view of a bag stack comprising a plurality of plastic bags.

With reference first to FIG. 1, bag stack 10 is illustrated which comprises an upper portion 13 and a lower portion 12. The lower portion 12 comprises a plurality of polyethylene bags, which are detachably connected to the upper portion 13 by perforations 15. Perforations 15 are formed in the manufacture of the bag stack 10 using well-known techniques.

Figure 2:
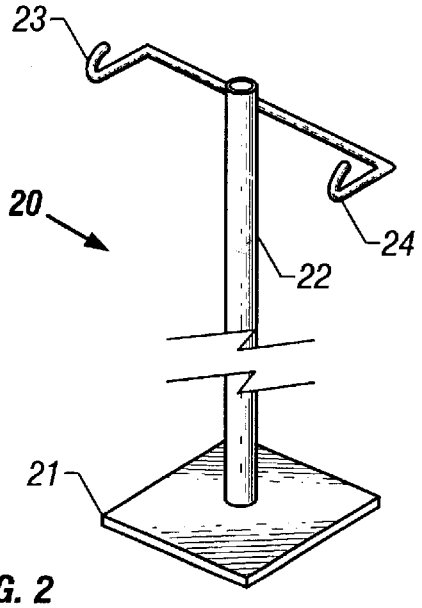
FIG. 2 is a perspective view of one type of bag stand for use in the present invention.
Figure 3:
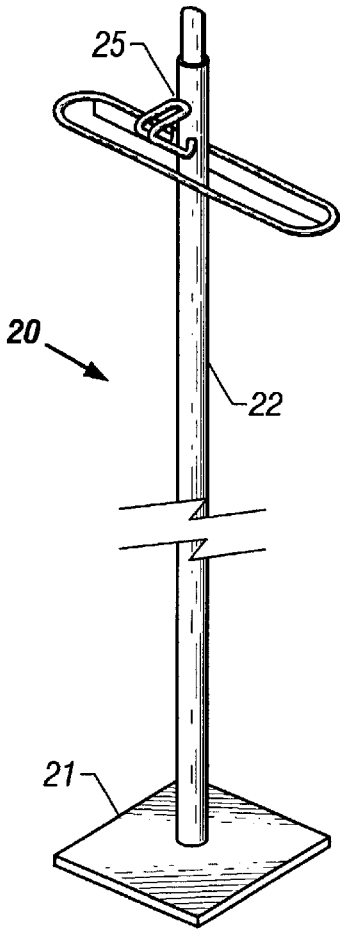
FIG. 3 is a perspective view of another type of bag stand for use with the present invention.

With reference now to FIGS. 2 and 3, the plastic bag dispensing apparatus of the present invention comprises a bag stand. As shown in FIG. 2, a suitable bag stand 20 comprises a base 21, a vertical elongate tubular member 22, and a pair of spaced apart support hooks 23 and 24 which are attached to the elongate tubular member near its top. Alternatively, as shown in FIG. 3, bag stand 20 may comprise a single support hook 25 which is attached to the vertical elongate tubular member 22 near its top.

With reference now to FIGS. 1–3, if bag stack 10 is a "headerless" stack, circular holes 16 and 17 are formed in the upper portion 13, and bag stack 10 is used with a bag stand, as illustrated in FIG. 2. If, however, bag stack 10 is a "header" stack, header 14 may be provided with two tabs 14*a* and 14*b* having openings therein, if a bag stand with two hooks, as illustrated in FIG. 2, is used. Alternatively, header 14 may be provided with one tab 14*c* with one opening therein, if a bag stand such as illustrated in FIG. 3 is used. For ease and economy of manufacture, header 14 may always be fabricated with all three tabs 14*a*, 14*b*, and 14*c*, so that the bag stack may be used with either the bag stand of FIG. 2 or the bag stand of FIG. 3.

Figure 4:
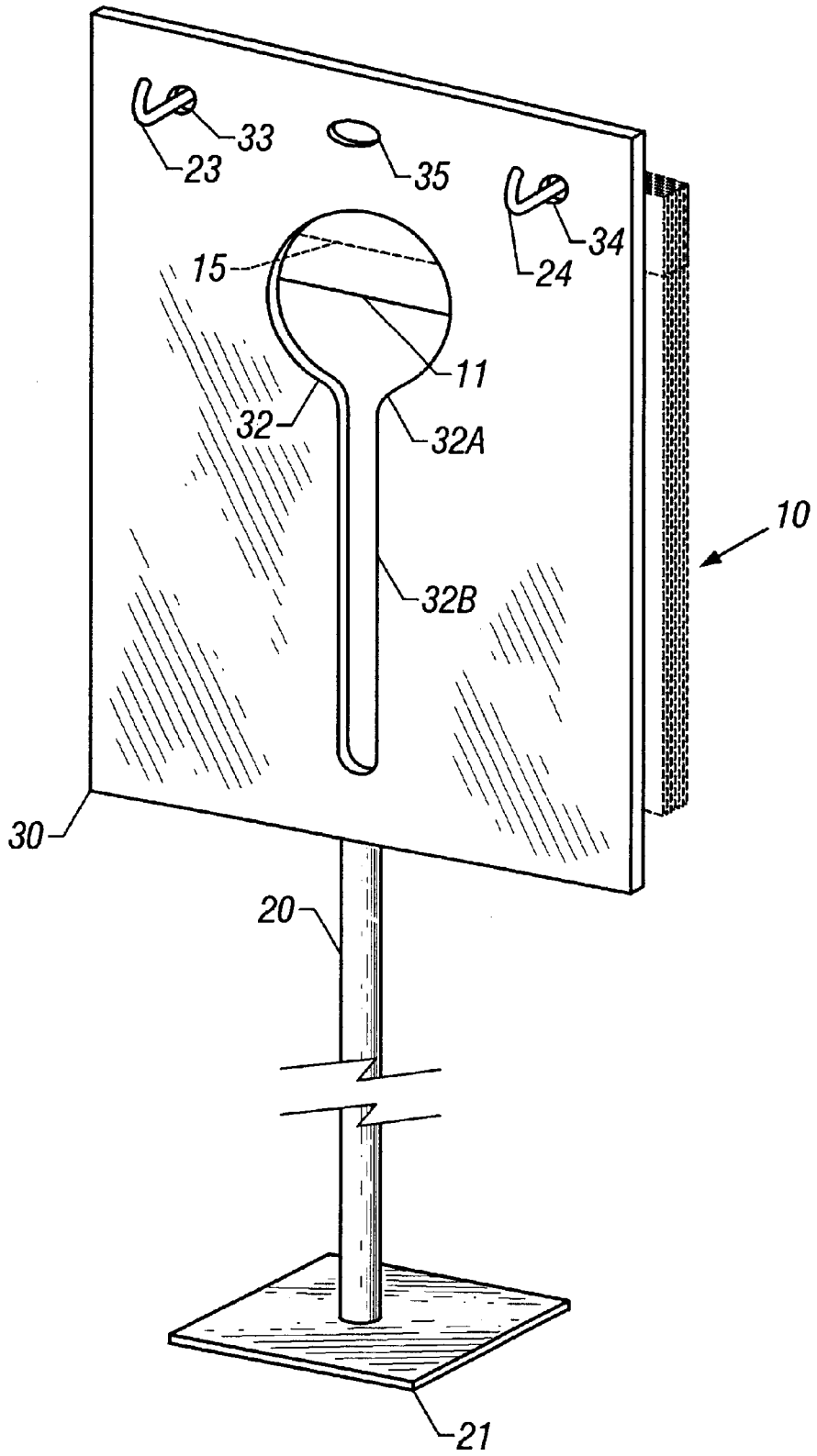
FIG. 4 is a perspective view of one embodiment of an apparatus for dispensing plastic bags in accordance with the present invention.

With reference now to FIG. 4, a plastic bag dispensing apparatus in accordance with the present invention comprises a bag stand 20 which includes at least one support hook. While the embodiment shown in FIG. 4 illustrates a bag stack with two support hooks 23 and 24, it will be appreciated that a bag stand with a single support hook may also be employed. The plastic bag dispensing apparatus of FIG. 4 also includes bag stack 10 which is formed, as described above, with a disposable upper portion and a lower bag portion comprising a plurality of bags that are detachably connected to the upper portion. The upper portion of bag stack 10 comprises at least one hole associated therewith for enabling the bag stack to be removably mounted on the support hook or hooks of the bag stand.

With reference still to FIG. 4, the bag shield 30 has a planar front. At least one hole is formed in the shield 30 for mounting the shield on the support hook of the bag stand 20. In the embodiment shown in FIG. 3, bag shield 30 has two substantially circular holes, 33, 34, formed near the top for mounting the shield 30 on support hooks 23 and 24. Alternatively, if the bag stand 20 had only the single support hook 25, the shield 30 would be mounted on that single support hook by using hole 35. Again, for ease and economy of manufacture, shield 30 may always be manufactured with three holes 33, 34 and 35.

Still referring to FIG. 4, an opening 32 is formed through the shield, and the opening 32 has an upper portion 32*a* which is substantially circular in shape. The opening 32 also includes a vertical elongate portion 32*b*. As shown in FIG. 3, the substantially circular portion 32*a* of opening 32 is on top of and contiguous with vertical elongate portion 32*b*.

In a preferred implementation, bag shield 30 in FIG. 4 is fabricated from clear vinyl that is ⅛ inch thick. The length of shield 30 is preferably 22 inches, and the width of shield 30 is preferably 12 inches. The diameter of the upper circular portion 32*a* is preferably 3.5 inches and the center of upper circular portion 32*a* is preferably located equidistant from the sides of the shield and approximately 4.75 inches from the top of the shield. Vertical elongate portion 32*b* is preferably about 1 inch wide and extends to about 1½ inches from the bottom of shield 30.

Figure 5:
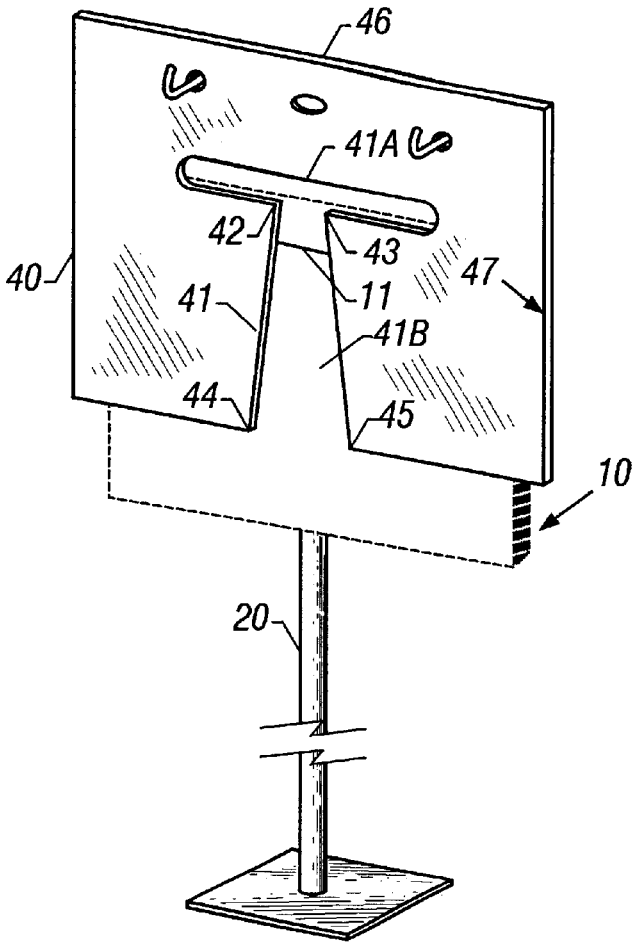
FIG. 5 is a perspective view of another embodiment of an apparatus for dispensing plastic bags in accordance with the present invention.

Now referring to FIG. 5, another embodiment of the plastic bag dispensing apparatus of the present invention is illustrated. The embodiment shown in FIG. 5 is identical to the embodiment shown in FIG. 4, except for the size of shield 40, and the shape of the opening formed in shield 40.

As illustrated in FIG. 5, shield 40 has an opening 41 formed therein which has an upper horizontal elongate portion 41*a*, which is on top of and contiguous with a funnel-shaped portion 41*b* that flares downwardly. The top of horizontal elongate portion 41*a* is approximately 3.25 inches from the top of shield 40, and the width of horizontal elongate portion 41*a* is approximately 0.75 inches. The length of horizontal elongate portion 41*a* is approximately 7.25 inches, and horizontal elongate portion 41*a* is centrally located between the two sides of shield 40. The distance between points 42 and 43 is preferably about 1.5 inches, and the distance between points 44 and 45 is preferably about 4 inches. The length of side 46 is preferably about 14 inches, and the length of side 47 is preferably about 12 inches. The shield 40 is preferably fabricated from clear vinyl having a thickness of ⅛ inch.

Figure 6:
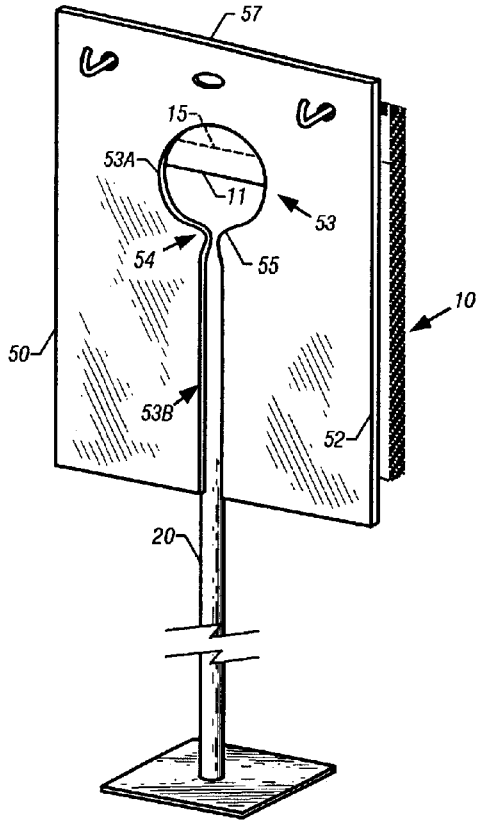
FIG. 6 is a perspective view of a third embodiment of an apparatus for dispensing plastic bags in accordance with the present invention.

With reference now to FIG. 6, a third embodiment of dispensing apparatus is illustrated. The embodiment of FIG. 6 is also identical to the embodiment of FIG. 4, except for the size of shield 50, and the shape of the opening formed in shield 50. Shield 50 is also preferably fabricated of clear vinyl which is ⅛ inch thick, and preferably has a width 51 equal to 12 inches, and a length 52 equal to about 16 inches. Shield 50 has an opening 53 formed therethrough which includes an upper portion 53*a*, which is substantially circular in shape. The diameter of upper circular portion 53*a* is preferably about 3.75 inches, and the center of upper circular portion 53*a* is preferably located about 4.875 inches from the top of shield 50.

The opening 53 also includes a lower vertical elongate portion, which is preferably about ¾ inches in width, and extends from the bottom of shield 50 to abutting projections 54 and 55. These abutting projections 54 and 55 are formed on each side of the top of vertical elongate portion 53*b*, and while the abutting projections are between the upper circular portion 53*a* from the lower vertical elongate portion 53*b*, the abutting projections are disposed adjacent to and in spaced relationship from one another, i.e., the abutting projections are not connected to one another.

What is claimed is:

1. A plastic bag dispensing apparatus, comprising:

a bag stand which includes at least one support hook;

a bag stack comprising a disposable upper portion and a lower bag portion comprising a plurality of plastic bags that are detachably connected to the upper portion, the upper portion of the bag stack including at least one hole formed therein for removably mounting the bag stack on the support hook of the bag stand; and a shield which is made from a flexible material, said shield having a substantially planar front face with (i) at least one hole therethrough for mounting the shield on the support hook, and (ii) an opening therethrough having a substantially circular shaped portion on top of and contiguous with a vertical elongate portion.

2. A plastic bag dispensing apparatus comprising:

a bag stand which includes at least one support hook;

a bag stack comprising a disposable upper portion and a lower bag portion comprising a plurality of plastic bags that are detachably connected to the upper portion, the upper portion of the bag stack including at least one hole formed therein for removably mounting the bag stack on the support hook of the bag stand; and a shield which is made from a flexible material, said shield having a substantially planar front face with (i) at least one hole therethrough for mounting the shield on the support hook, and (ii) an opening therethrough which has an upper horizontal elongate portion on top of and contiguous with a funnel-shaped portion that flares downwardly.

3. A plastic bag dispensing apparatus comprising:

a bag stand which includes at least one hook; a bag stack comprising a disposable upper portion and a lower bag portion comprising a plurality of plastic bags that are detachably connected to the upper portion, the upper portion of the bag stack including at least one hole formed therein for removably mounting the bag stack on the hook of the bag stand; and a shield which is made from a flexible material, said shield having a substantially planar front face with (i) at least one hole therethrough for hanging the shield on the hook, (ii) an opening therethrough having an upper circular shaped portion and a lower vertical elongate portion, and (iii) abutting projections which are disposed in spaced relationship to one another at the top of the vertical elongate portion and which are between the upper circular portion and the vertical elongate portion.

* * * * *